United States Patent [19]

Whyte

[11] Patent Number: 4,790,035

[45] Date of Patent: Dec. 13, 1988

[54] HEADGEAR

[76] Inventor: Iris Whyte, 22 West Park, Mottingham, London, SE9 4RQ., England

[21] Appl. No.: 77,738

[22] Filed: Jul. 27, 1987

[30] Foreign Application Priority Data

Jul. 25, 1986 [GB] United Kingdom ..... 8618164

[51] Int. Cl.[4] ..... A42B 5/00

[52] U.S. Cl. ..... 2/207; 2/198

[58] Field of Search ..... 2/207, 198, 174, 68, 2/91, 183, 189

[56] References Cited

U.S. PATENT DOCUMENTS

| | | | |
|---|---|---|---|
| 1,749,340 | 3/1930 | Grean | 2/198 |
| 2,336,356 | 12/1943 | Harding | 2/198 |
| 2,396,503 | 3/1946 | Greer | 2/198 |
| 2,653,326 | 9/1953 | Ged | 2/198 |
| 2,694,204 | 11/1954 | Cross | 2/198 X |
| 3,201,803 | 8/1965 | Gettinger | 2/207 |
| 3,380,076 | 4/1968 | Held | 2/207 |
| 3,605,121 | 9/1971 | Suzuki | 2/207 |
| 4,491,985 | 1/1985 | Dalton | 2/198 X |

*Primary Examiner*—Louis K. Rimrodt
*Assistant Examiner*—J. L. Olds
*Attorney, Agent, or Firm*—James Creighton Wray

[57] ABSTRACT

A turban hat comprising an elongate strip of material having two arms (6,7), respective arms extending from a mid-point (8) between the ends of the strip to a respective distal one of said ends and each arm having first and second edges, at least one of said arms being looped around the other, each arm having at least a portion of either of its edges adjacent its distal end attached to at least a portion of an edge of an arm adjacent the mid-point and at least a portion of either of its edges adjacent its distal end attached to at least a portion of an edge of the other arm adjacent the distal end, the loop being arranged so that one arm can be pulled through the other arm to alter the "hat size" of the headgear.

Preferably a first portion (**9*b*) of a first edge of one arm (6) adjacent the distal end of said arm (6) is attached to a second portion (9*a*) of said edge of said arm (6) adjacent said mid-point and a first portion (11*b*) of a first edge of the other arm (7) adjacent the distal end of said arm (7) is attached to a second portion (11*a* ) of said edge of said arm (7**) adjacent said mid-point.

2 Claims, 4 Drawing Sheets

HEADGEAR

The present invention relates to headgear and more particularly, but not solely, to a hat or item of headgear for women to prevent their hair becoming wet or disturbed.

STATEMENT OF THE INVENTION

According to the present invention there is provided an item of headgear comprising an elongate strip of material having two arms, respective arms extending from a mid-point between the ends of the strip to a respective distal one of said ends and each arm having first and second edges, at least one of said arms being looped around the other, each arm having at least a portion of either of its edges adjacent its distal end attached to at least a portion of an edge of an arm adjacent the mid-point and at least a portion of either of its edges adjacent its distal end attached to at least a portion of an edge of the other arm adjacent the distal end, the loop being arranged so that one arm can be pulled through the other arm to alter the "hat size" of the headgear.

BRIEF DESCRIPTION OF THE DRAWINGS

A constructional embodiment of the present invention will now be described, by way of example, with reference to the accompanying drawings, wherein.

DESCRIPTION OF PREFERRED EMBODIMENT

Figure 1:
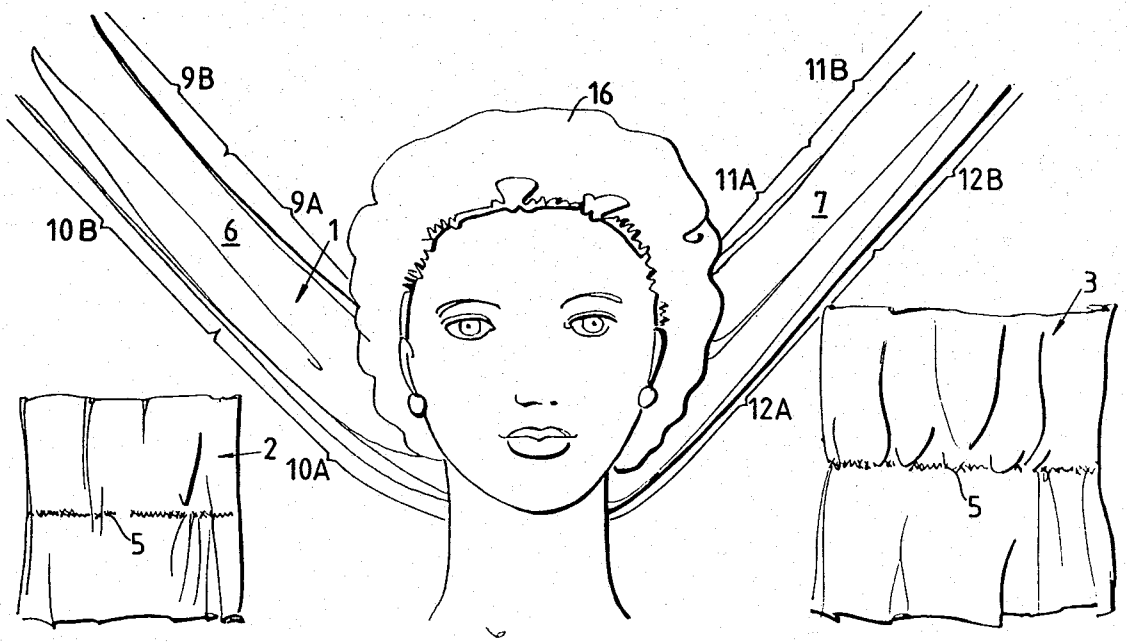
FIG. 1 shows a first stage in making an item of headgear in accordance with the present invention.

As shown in FIG. 1 there are provided three pieces of material 1,2 and 3. The piece 1 measures about 117 cm×20.25 cm, the piece 2 about 15.25 cm×12.75 cm and the piece 3 about 20.25 cm×20.25 cm. The pieces 2 and 3 are gathered or ruffled by stitching approximately along their centre lines 5. The piece 1 is in the form of a strip having arms 6 and 7 extending from a mid-point 8 (FIG. 3) between the ends of the strip to a respective distal one of said ends. The arm 6 has first and second edges, the first edge comprising a part 9A adjacent the mid-point 8 and a part 9B adjacent its distal end and the second edge comprising a part 10A adjacent mid-point 8 and a part 10B adjacent its distal end. Likewise the arm 7 has first and second edges comprising parts 11A, 11B, 12A and 12B.

Figure 2:
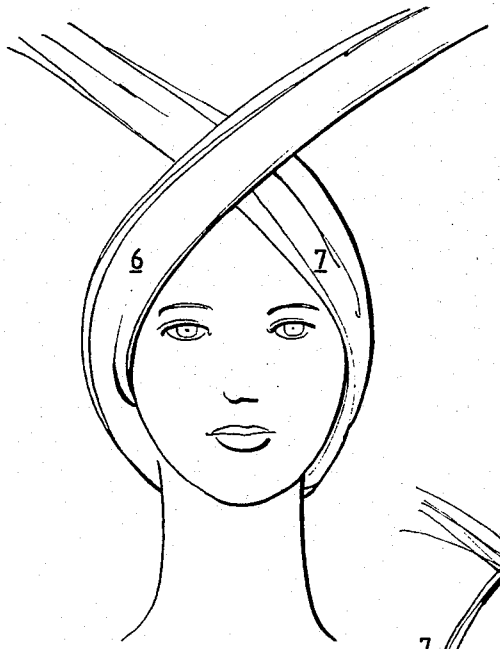
FIGS. 2 and 3 show front and rear views, respectively, of a second stage.
Figure 3:
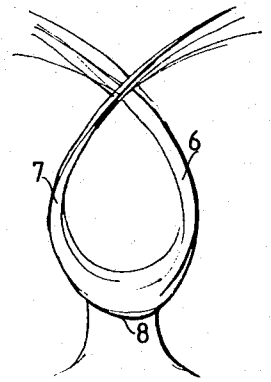
Figure 4:
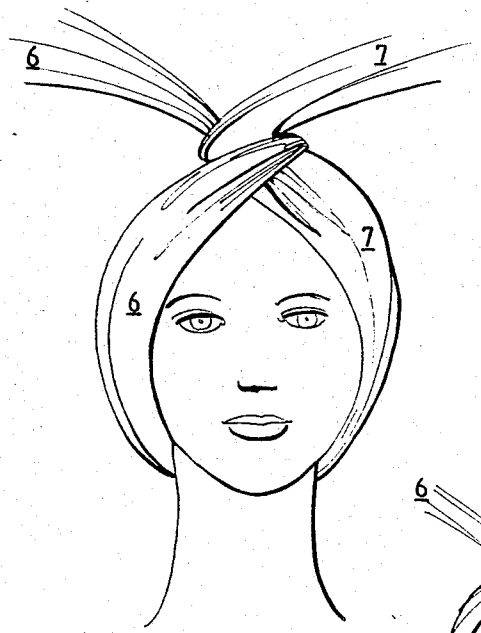
FIGS. 4 and 5 show front and rear views, respectively, of a third stage.
Figure 5:
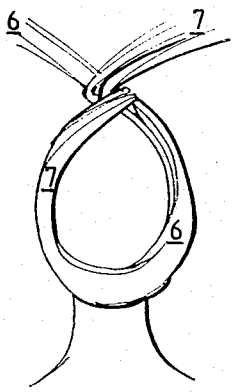

As shown in FIGS. 2 and 3 the arms 6 and 7 cross over each other and as shown in FIGS. 4 and 5 at least one of the arms is looped around the other. The arms may be looped as shown in FIG. 4 with each being looped around the other so that each folds back on itself in a U-shape or one arm may be looped completely around the other as shown in FIG. 5. As the arms 6 and 7 are looped around each other they may be turned over to show a different side of the material. The sides of the material can be of different colour or texture.

Figure 6:
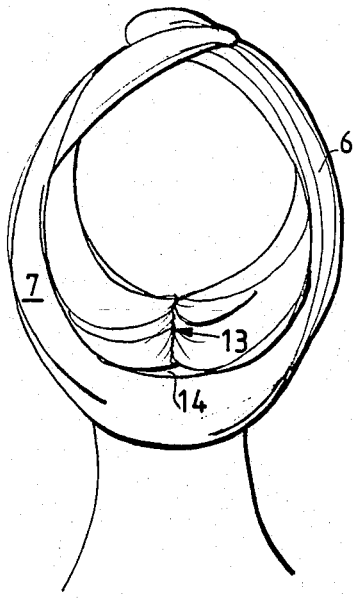
FIGS. 6 and 7 show rear views of a fourth stage.

Then as shown in FIG. 6 the distal ends are stitched together at 13. Thereafter, also as shown in FIG. 6 edge parts 9A to 12B are sewn together and this can be in one of the following ways, viz:

1. With the arms looped as shown in FIG. 4 and the material not turned over, edge part 9B is stitched to part 9A and part 11B is stitched to part 11A.
2. With the arms looped as shown in FIG. 5 and the material not turned over, part 12B is stitched to part 9A and part 10B is stitched to part 11A.
3. With the arms looped as shown in FIG. 4 and the material turned over, edge part 12B is stitched to part 11A and part 10B to part 9A.
4. With the arms looped as shown in FIG. 5 and the material turned over, edge part 11B is stitched to part 9A and part 9B to 11A.

Of course it is possible to turn over only one of the arms 6 and 7 as they are looped around each other.

Figure 7:
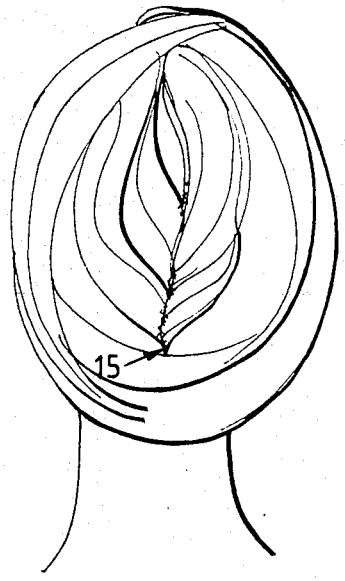

An aperture 14 is formed by leaving a small area unstitched and then as shown in FIG. 7 the remaining edge part of arm 6 adjacent its distal end is stitched to the remaining edge part of arm 7 adjacent its distal end along a seam 15.

Figure 8:
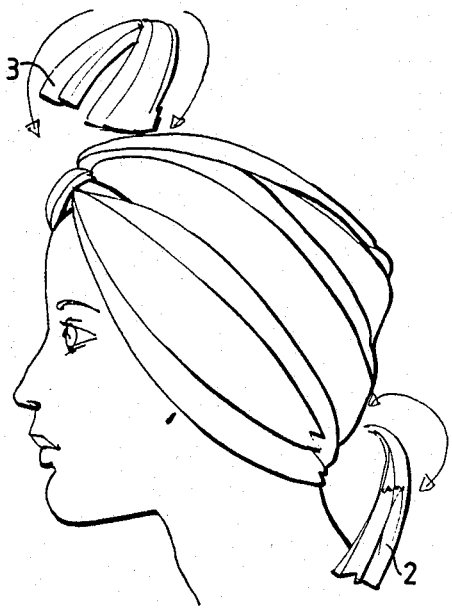
FIGS. 8 and 9 show side and rear views, respectively, of a fifth stage.
Figure 9:
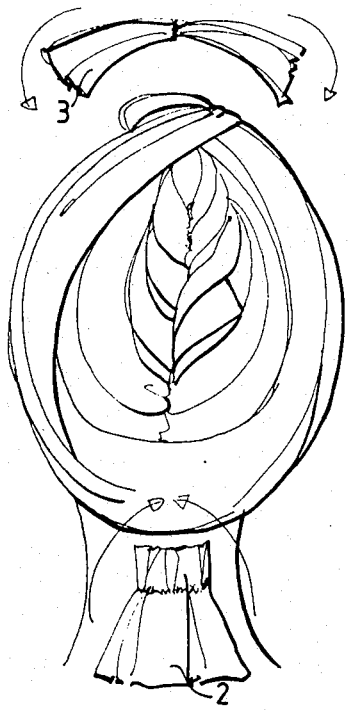

As shown in FIGS. 8 and 9 the piece of material 3 is passed through the loop of the arms 6 and 7 and around both arms. The ends of the piece of material 3 are then stitched to each other. The piece of material 2 is passed through the aperture 14 and around the midpoint 8. The ends of the piece of material 2 are then stitched to each other.

Figure 10:
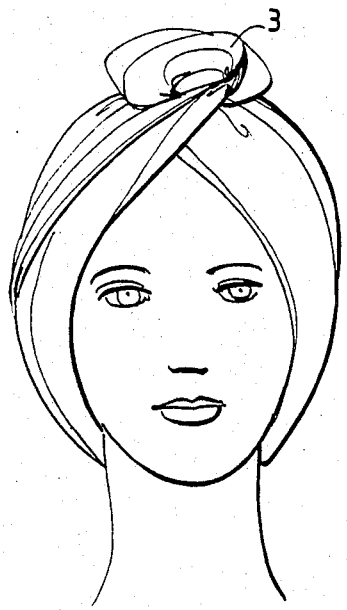
FIGS. 10 and 11 show front and rear views, respectively, of the completed item of headgear.
Figure 11:
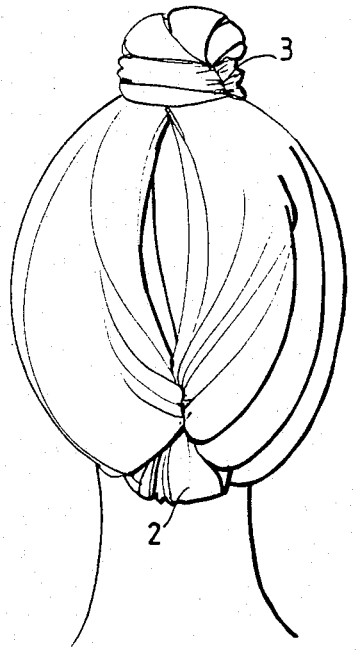

The completed item of headgear shown in FIGS. 10 and 11 has the appearance of a turban or a towel wrapped around a head after the hair has been washed, but it is firm and does not become undone. Nevertheless the "hat size", that is the size required to wrap neatly and firmly around a head, is adjustable because one of the arms 6 and 7 can be pulled through the other by virtue of the looping arrangement. The piece of material 3 is suitably adjusted to maintain the neat appearance.

The headgear is preferably made of 80% cotton/20% nylon towelling. It may be made of cotton jersey or silk polyester.

As shown in FIG. 1 there may be provided an insert 16 made of waterproof material such as plastics material. The insert 16 is preferably attached by means of a couple or a few stitches at the top at or adjacent the loop of the arms 6 and 7 and at the bottom at or adjacent the mid-point 8. The insert is easily removable by severing the stitches. The item of headgear with insert provides an attractive hat particularly for use by women to protect their hair when they are putting on make-up, in the bath, sunbathing or in a swimming pool. It is not designed to be a swimming hat but will be adequate protection for women who paddle, relax or play in the sea or a swimming pool but do not swim or who swim with their heads substantially out of the water. The item of headgear is particularly useful to skiers and skaters.

I claim:

1. A pre-fabricated hat comprising an elongate strip of material having terminal ends, a mid-point between the ends having two arms, respective arms extending from said mid-point to a respective distal one of said ends and each arm having first and second edges, at least one of said arms being looped around the other, each arm having at least a portion of either of its ends adjacent its distal end attached to at least a portion of an edge of an arm adjacent the mid-point and at least a portion of either of its edges adjacent its distal end attached to at least a portion of an edge of the other arm adjacent the distal end, the loop being arranged so that one arm can be pulled through the other arm to alter the "hat size".

2. A pre-fabricated hat comprising an elongate rectangular strip of material having terminal ends, a mid-point between the ends and having two arms, respective arms extending from said mid-point to a respective distal one of said ends and each arm having first and second edges, each arm being looped around the other, wherein a first portion of a first edge of one arm adjacent the distal end of said arm is stitched to a second portion of said edge of said arm adjacent said mid-point and first portion of a first edge of the other arm adjacent the distal end of said arm is stitched to a second portion of said edge of said arm adjacent said mid-point, the loop being arranged so that one arm can be pulled through the other arm to alter the "hat size".

* * * * *